United States Patent [19]

Vaisman

[11] Patent Number: 4,546,025

[45] Date of Patent: Oct. 8, 1985

[54] MULTI-LATERAL EDGE UNIT HAVING AN ASYMMETRICAL DESIGN THAT EXTENDS TO THE LATERAL EDGES

[76] Inventor: Jakov Vaisman, 2980 W. 28th St., Brooklyn, N.Y. 11224

[21] Appl. No.: 588,437

[22] Filed: Mar. 12, 1984

Related U.S. Application Data

[63] Continuation of Ser. No. 183,463, Sep. 2, 1980, abandoned and continuation of Ser. No. 878,350, Feb. 16, 1978, abandoned.

[51] Int. Cl.[4] ..... B44C 1/28

[52] U.S. Cl. ..... 428/47; 52/311; 428/49; 428/80; 428/904.4

[58] Field of Search ..... 52/311, 390; 156/63; 273/157 R; 428/47, 48, 49, 80, 904.4

[56] References Cited

U.S. PATENT DOCUMENTS

| | | | |
|---|---|---|---|
| D. 252,092 | 6/1979 | Popeck | D25/93 X |
| D. 252,094 | 6/1979 | Popeck | D25/93 X |
| 1,838,108 | 12/1931 | Rhodes | 428/80 |
| 2,114,474 | 4/1938 | Labra | 428/49 X |
| 2,835,936 | 5/1958 | Elmendorf | 428/47 |
| 3,002,309 | 10/1961 | Snyder | 428/47 X |
| 3,191,937 | 6/1965 | Kropinski | 428/47 X |
| 3,242,594 | 3/1966 | Smith | 428/47 X |
| 3,247,299 | 4/1966 | Zaha | 428/49 X |
| 3,703,431 | 11/1972 | Kemper | 428/47 X |
| 3,875,716 | 4/1975 | Eusemann | 428/49 X |
| 4,133,152 | 1/1979 | Penrose | 428/47 X |
| 4,177,305 | 12/1979 | Feingold et al. | 428/47 X |
| 4,307,886 | 12/1981 | Kemper | 273/157 R X |

*Primary Examiner*—Henry F. Epstein

*Attorney, Agent, or Firm*—Alexander C. Wilkie, Jr.; Vincent P. Pirri

[57] ABSTRACT

A unit is described for use in a multi-unit decorative or structural arrangement. Each unit has, on at least one surface, an asymmetrical design which may be two dimensional or three dimensional. These asymmetrical designs are arranged to permit a number of identical units to be arranged together to form a large variety of overall designs whose final form depends upon the relative positions of the individual units within the arrangement. For example, a number of identical square tiles are provided, each having the same design and with the design created so that a tile wall can be formed from the identical tiles with hundreds of different overall designs. The same large number of overall designs may be formed from units other than square units including three dimensional building blocks and similar basic decorative or construction units.

21 Claims, 30 Drawing Figures

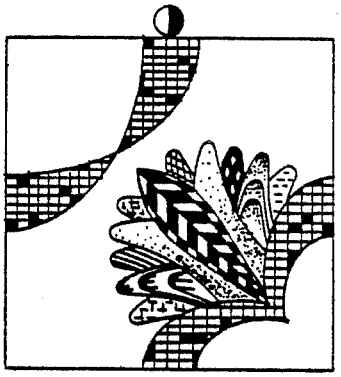
FIG. 3
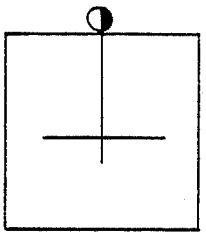
FIG. 3A
FIG. 3B
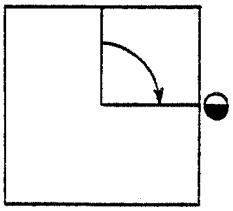
Position 1.
(90°)
FIG. 3C
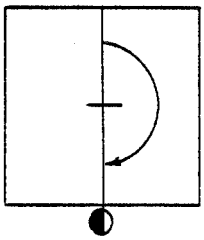
Position 2.
(180°)
FIG. 3D
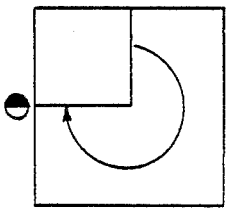
Position 3.
(270°)
FIG. 3E
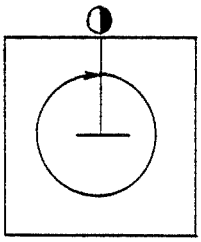
Position 4.
(360°)

FIG. 4
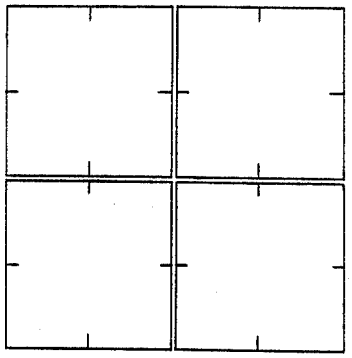
FIG. 5
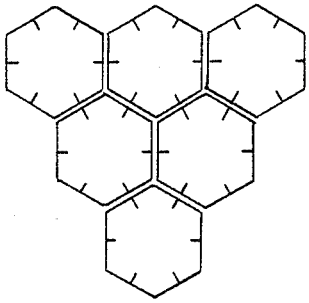
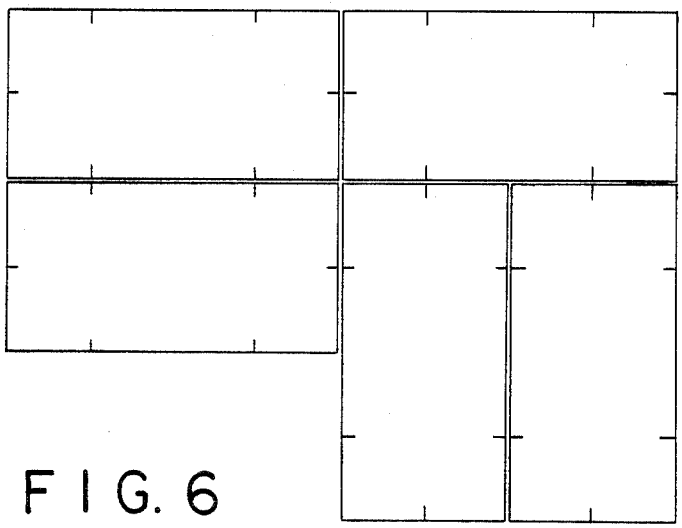
FIG. 6

FIG. 13
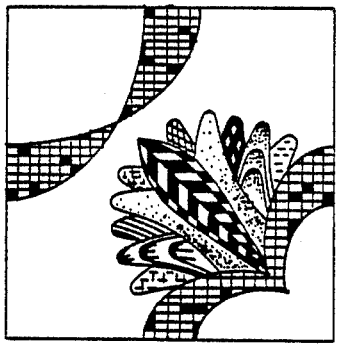
FIG. 14
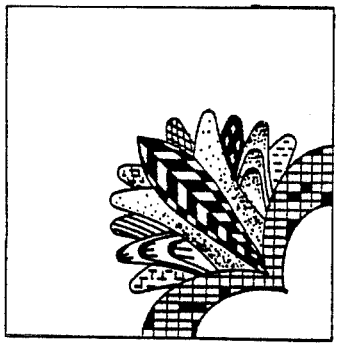
FIG. 15
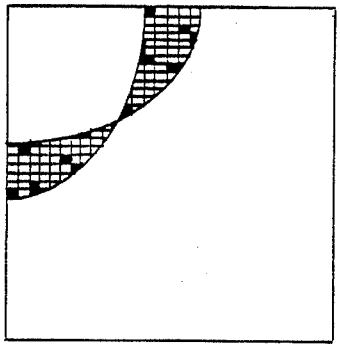
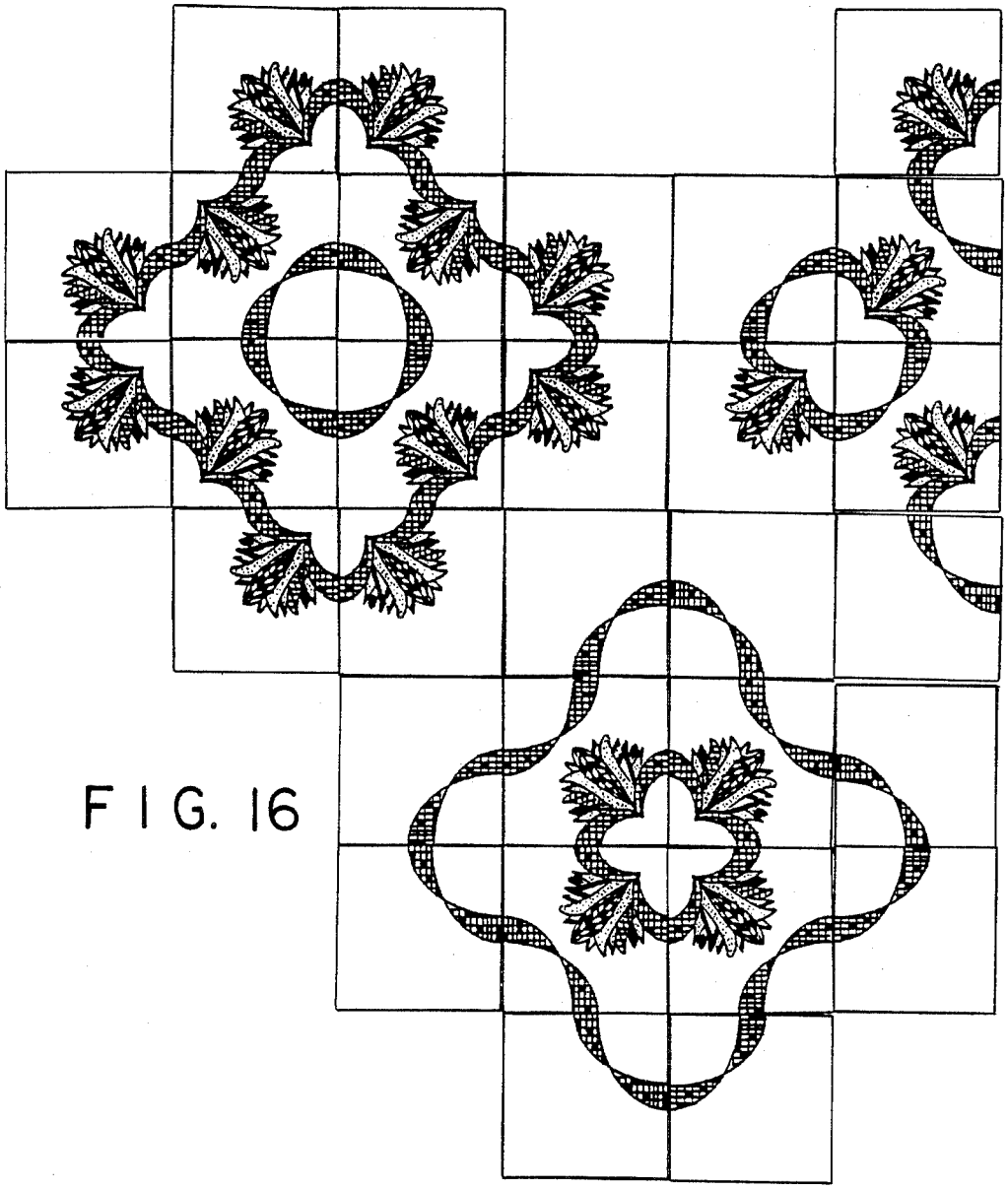
FIG. 16

FIG. 17A
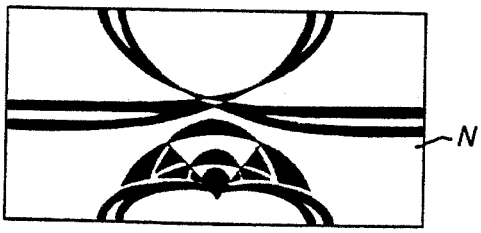
FIG. 17B
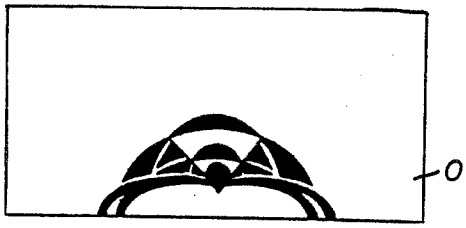
FIG. 17C
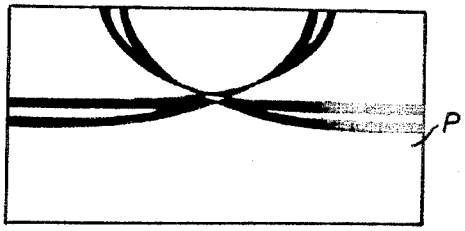
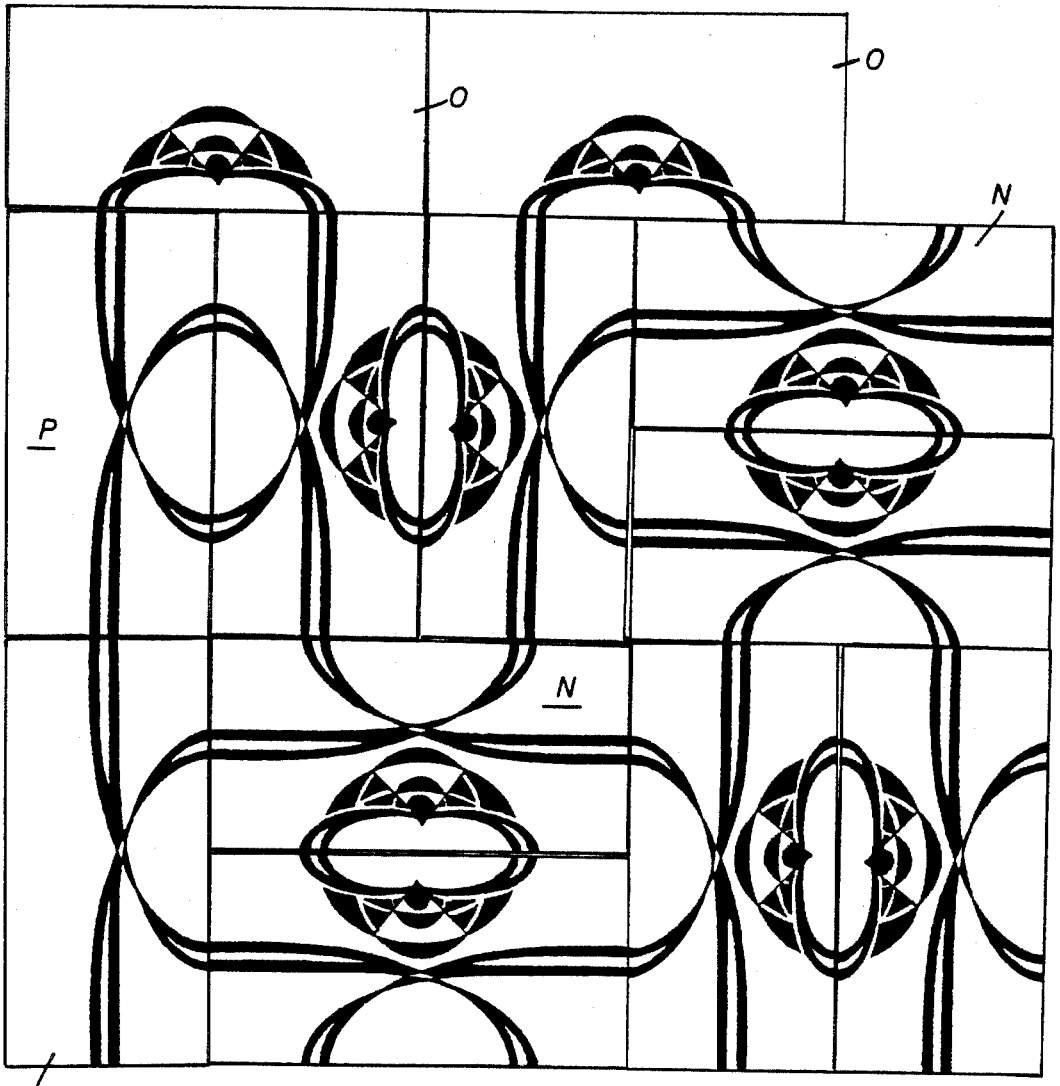
FIG. 17

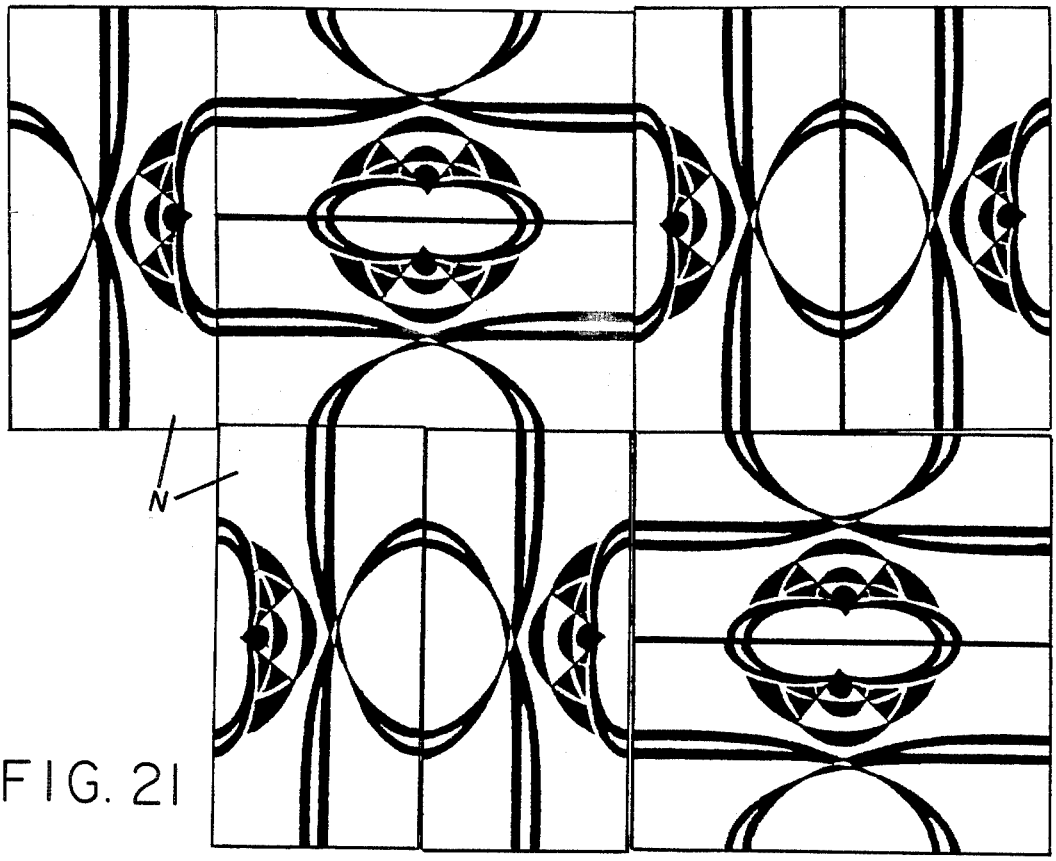
FIG. 21
FIG. 22
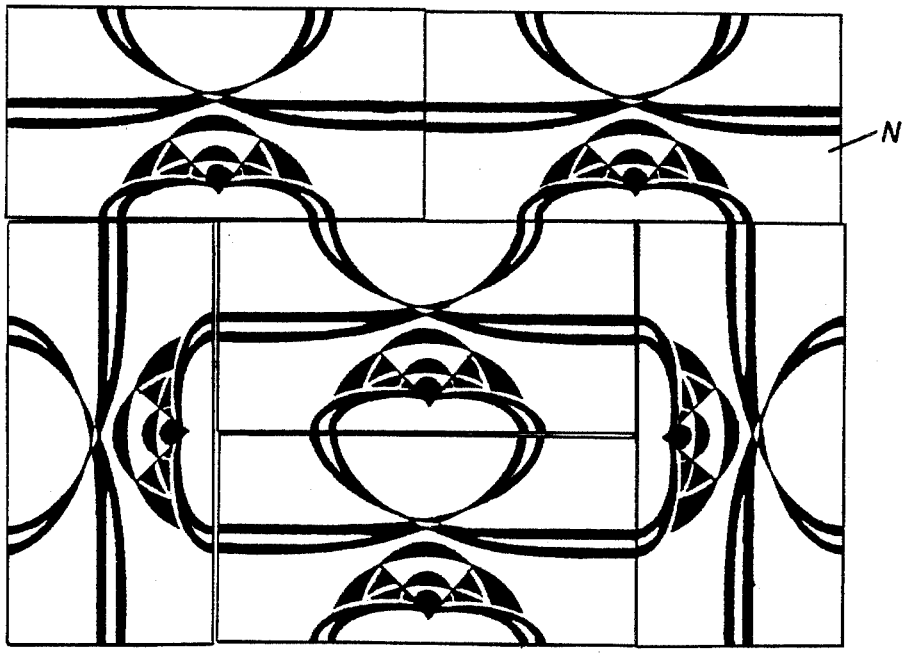

MULTI-LATERAL EDGE UNIT HAVING AN ASYMMETRICAL DESIGN THAT EXTENDS TO THE LATERAL EDGES

This is a continuation of application Ser. No. 183,463 filed on Sept. 2, 1980 and now abandoned which in turn is a continuation of Ser. No. 878,350 filed Feb. 16, 1978 and now abandoned.

The present invention relates to a method and means for decoration or construction using a number of identical units having a two or three dimensional design on one surface. More particularly, the invention relates to a method of forming identical designs on individual units so that a large number of overall designs may be obtained depending upon the particular orientation of the individual units within the overall surface or structure.

The units, which may be decorative tiles or plaques or building blocks or the like, are characterized by having identical asymmetrical designs on one surface. The designs are laid out to permit the units to be assembled with a variety of positions in respect to one another in forming differing overall designs. When a decorated square unit is used, for example, the individual design chosen permits several hundred different overall decorative wall or other designs to be formed using only the one basic unit design.

This permits a standardization and a significant cost saving in the manufacture and supply of decoration and construction units. With only a single and easily produced design being used, hundreds of different, visually distinct, attractive composite arrangements may be obtained. One of the many examples of this invention would be its use on common square decorative tiles. Using a single tile design for forming a household tile surface, several hundred different wall designs would be available for apartment construction using only a single decorative unit tile. The principal, as will be more fully explained below, is applicable to many other construction or decorative uses where similar inexpensive and mass produced units may be employed in producing large numbers of completed assemblies of differing and customized appearances.

Accordingly, the object of the present invention is to provide an improved decoration or construction unit permitting individualized designs based upon the use of identical construction units.

Another object of the invention is to provide an improved decorative or construction element capable of producing a large number of differing assemblies from identical individual units.

Another object of the invention is to provide low cost customized decorated surfaces or structures at low cost.

Another object of the invention is to provide an improved method of forming a large variety of differing designs from identical individual units.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 3 is a plan view illustrating the design shown in FIG. 2 orientated in a specific manner.

FIG. 3A is a schematic plan view of FIG. 3 without the design and orientated in the same manner.

FIG. 3B is a schematic plan view shown in FIG. 3 without the design and orientated 90° clockwise.

FIG. 3C is a schematic plan view shown in FIG. 3 without the design and orientated 180° clockwise.

FIG. 3D is a schematic plan view shown in FIG. 3 without the design and orientated 270° clockwise.

FIG. 3E is a schematic plan view shown in FIG. 3 without the design and orientated 360° clockwise to the position as shown in FIGS. 3 and 3A.

FIG. 4 is a diagramatic view showing an assembly of square units illustrating a variety of unit placements.

FIG. 5 is a diagramatic illustration of a hexagonal unit assembly illustrating possible variations.

FIG. 6 is a diagramatic view illustrating rectangular units assembled in a variety of arrangements.

FIGS. 13 through 15 illustrate three related unit designs for use in the method of the invention including treatment of border or marginal areas.

FIG. 16 is a plan view of a unit arrangement utilizing the units of FIGS. 13 through 15 and showing a method for border or margin arrangement.

FIG. 17 illustrates an arrangement of non-square units.

FIGS. 17A, 17B and 17C illustrates non-square units employed in the design arrangement of FIG. 17.

FIGS. 18 through 22 illustrate additional arrangements of non-square units.

DESCRIPTION OF THE PREFERRED EMBODIMENT

The configuration of the individual unit i.e. its contour or design is such that a number of identical assembled units create a single decorated surface or a single three dimensional figure.

Both planar formations and three-dimensional formations may be used employing graphics, painting, sculpture, sculptural relief, mosaic, chiselling, casting, etc., and using various materials, both natural and synthetic including ceramic, glass, concrete, wood, plastics, fabrics and others.

The products presently used by architects, in both exterior and interior decoration, are characterized by a diversity of stylistic peculiarities, textural differences, and varied materials.

These products are further normally characterized by one common property which is their use in only obtaining a completely uniform and constantly repeating surface pattern. The structure and character of the pattern of these products when assembled creates only one uniform composition with a particular repeating pattern.

In the past, covering the floor of a room, for example, required a number of differently decorated elements from which the overall pattern of the floor of the particular room was put together. Contemporary mass production with its demand for standardization and unification is not able, without an excessive increase of the cost of production, to produce articles having many differing patterns or drawings, When differing designs are required, it is done on an individual basis with a significant increase in expense for the design and manufacture.

The following is a description of a unit having the capacity for permitting the formation of a large number of differing decorative and artistic figurative compositions from identical mass produced units.

Figure 1:
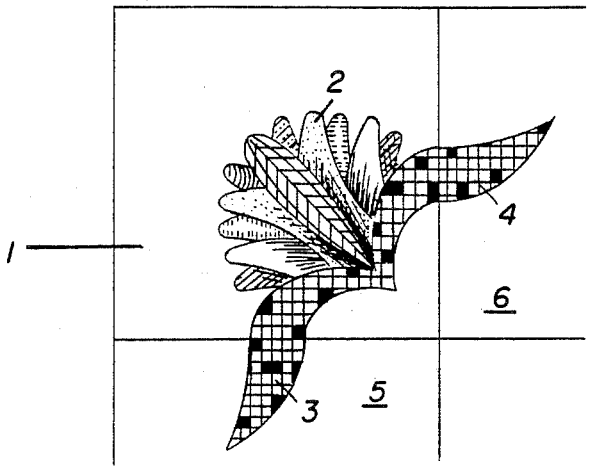
FIG. 1 is a plan view of a design in accordance with the invention.
Figure 2:
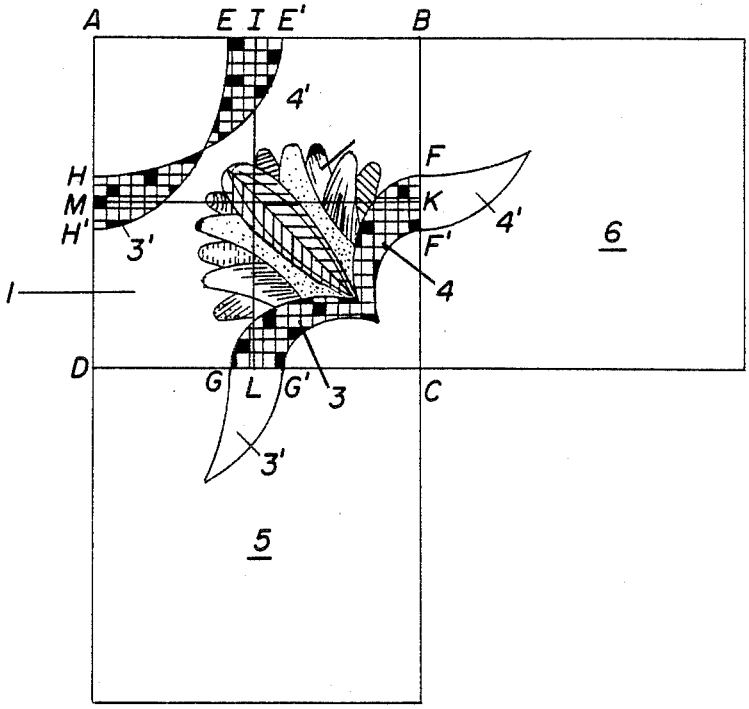
FIG. 2 is a plan view corresponding to FIG. 1 illustrating a step in the design of a decoration unit.

As a sample unit decoration, for descriptive purposes, a leaved flower 2 is used in a decorative shape which suggests wings (FIG. 1). In the square unit 1 illustrated and with the possibility of moving the design fragment in the plane of the unit, a position is selected for the leaved flower 2 at which its main part is moved into the right lower corner of the unit 1. The flower leaf 3 crosses the unit 1 side in the middle of side DC and the leaf 4 in the middle of the side BC, (FIG. 2). Beyond the area of the main unit, there remains a part 3' of the lower leaf 3 in the unit 5 while the cut-off part 4' of the upper leaf 4 remains in the unit 6, (FIG. 2). In order to maintain all three partitioned elements of the design in the limits of the main unit 1, additional changes are made. The unit 5 is moved upwards to the position where the unit 5 overlies the unit 1. Now the cut-off part of the leaf fragment 3' will be inside the main unit 1. A similar movement of the upper unit 6 so that it overlies the unit 1 moves the cut-off part 4' of the leaf 3 into the unit 1.

Thus within the border of the closed unit 1, we have all three elements of the leaved flower design. In this arrangement, the width of both leaves 3 and 4 at the position where they cross over the edges of the main unit 1 are equal, i.e. FF'=GG', and the points K and L are the middle points of the sides BC and DC, i.e., HH'=EE',FF',GG', and the distances between the corners of the unit 1 and the leaf crossovers are equal, i.e, AE=E'B=BF=F'C=CG'=GD=DH'=HA.

Thus, the significant features of the unit 1 are in the symmetry of the partitioned elements of the decorative flower relative to the square axes MK and IL and the center of the square unit and in the equal width of the leaves at their crossing points at the unit edge and in the symmetry of the points E and E' relative to the point I; points F and F' relative to point K; points G and G' relative to point L; and points H and H' relative to point M.

These features of the design of the partitioned fragments are the key to the new wide image possibilities inherent in the unit, i.e., the possibility to produce from identical units a large number of various image combinations both by rythm and composition.

The ability to form a large number of compositions from assemblies of the same unit follows from the fact that on the image plane, which consists of identical units, each unit can change its position while turning around its geometrical center for 90° (FIG. 3B), 180° (FIG. 3C), 270° (FIG. 3D), and 360° (FIG. 3E) (FIGS. 3, 3A, 3B, 3C, 3D, 3E and 4). With each turn a new and different image composition is formed. With every new turn the partitioned elements of the unit form a new combination with other partitioned elements of the adjacent unit.

Should the units be shaped in the form of equilateral hexagons, each new shape is formed by turning the unit around its geometrical center of 60°, i.e, 120°, 180°, 240°, 300° and 360° (FIG. 5).

Should the unit be formed in the shape of a rectangle with side proportions of 1:2, each new composition is achieved by turning the unit for 180° or by turning a few units simultaneously (FIG. 6).

The same ability to form new image compositions is also available in three dimensional units having their structural designs similar to those of the plane units as described above.

In this case, with each new position change of the volumetric units in the image plane, the volumetric partitioned elements from a new combination with the volumetric partitioned elements of the adjacent units.

The joining of the adjacent units occurs at the cross-section of the relief in planes which are perpendicular to the unit plane.

It will be seen that these improved decorative or construction units offer practically unlimited possibilities for the manufacturing of new materials and products for the decorative and applied arts.

The units may be made from natural or synthetic materials manufactured by a variety of methods and material treatments and in a variety of colors and compositions with various surface treatments.

A great number of different artistic or decorative compositions can be created from the inexpensive identical units giving the possibility of creating almost unlimited numbers of different compositions. For example, from 20 identical units it is possible to create one billion different compositions.

In order to determine the total number of possible image compositions, we have to consider all the possible position changes for the units that form an image field, including the possible position change of each individual unit for 90°, 180°, 270°, 360° (see FIGS. 3, 3A, 3B, 3C, 3D, and 3E). This consideration also includes the possible position change of a few units simultaneously in any of its combinations with 2, 3, 4, 5, etc. units forming the image field. Also other possible unit position changes where each unit can change its position asynchronous with other units i.e, one unit on a 90°, a second unit on 180°, a third on 270°, a fourth on 360°, a fifth on 180°, (90°, 270° . . . etc.) i.e., using all possible unit combinations and movements.

An example follows where all possible combinations of 2 units A and B can be observed.

| UNIT | EACH UNIT TURN (in degree) | | | | | | | | | | | | | | | |
|---|---|---|---|---|---|---|---|---|---|---|---|---|---|---|---|---|
| A | 90 | 90 | 90 | 90 | 180 | 180 | 180 | 180 | 270 | 270 | 270 | 270 | 360 | 360 | 360 | 360 |
| B | 90 | 180 | 270 | 360 | 90 | 180 | 270 | 360 | 90 | 180 | 270 | 360 | 90 | 180 | 270 | 360 |

The total number of image combinations equals 16. Thus, if movements of one unit can form 4 combinations, then movements of 2 units can form 16 combinations, i.e., ($4^2=16$).

Using this method we can determine a number of possible overall design compositions for any number of units which form an image or design field according to the formula $S=4^n$, where n is the number of units that form an image field, and 4 corresponds to a number of possible changes for a unit of a square configuration.

For example, if we add a unit C in all its possible positions (90°, 180°, 270°, 360°) to the units A and B as shown above, then there will be 16 new combinations at C-90°; 16 new combinations at C-180°; 16 new combinations at C-270°, and 16 new combinations at C-360° (i.e, all the image compositions that correspond to the formula $S=4^3=64$).

For the units that have the shape of an equilateral hexagon, this formula will be expressed $S=6^n$.

This means that the number of image or design compositions for the field that consists of 4 units will number $S=4^4$, i.e, 256 (for a square); for 5 units $S=4^5$, i.e., 1024, for 6 units $S=4^6$, i.e., 4096; etc., so that 10 units will provide 1,048,576 possible overall designs.

Figure 7:
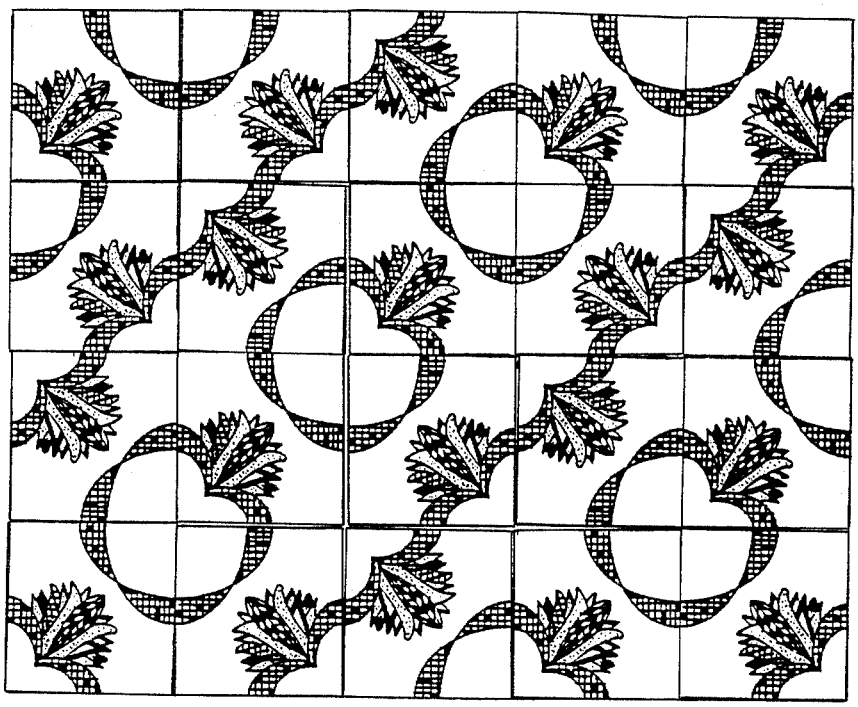
FIGS. 7 through 12 are plan views of unit arrangements each illustrating a differing design and all assembled from a number of tiles of the tile design of FIG. 2.

FIGS. 7 through 12 illustrates a number of differing designs formed from an arrangement of identical units or tiles. The unit closed for these illustrations is the unit of FIGS. 2 and 3. FIG. 7, for example, shows a particular design with the identical tiles fitted together so that an overall pattern comprising a diagonal garland effect is obtained with the garlands being diagonal rows of a floral-like design.

Figure 8:
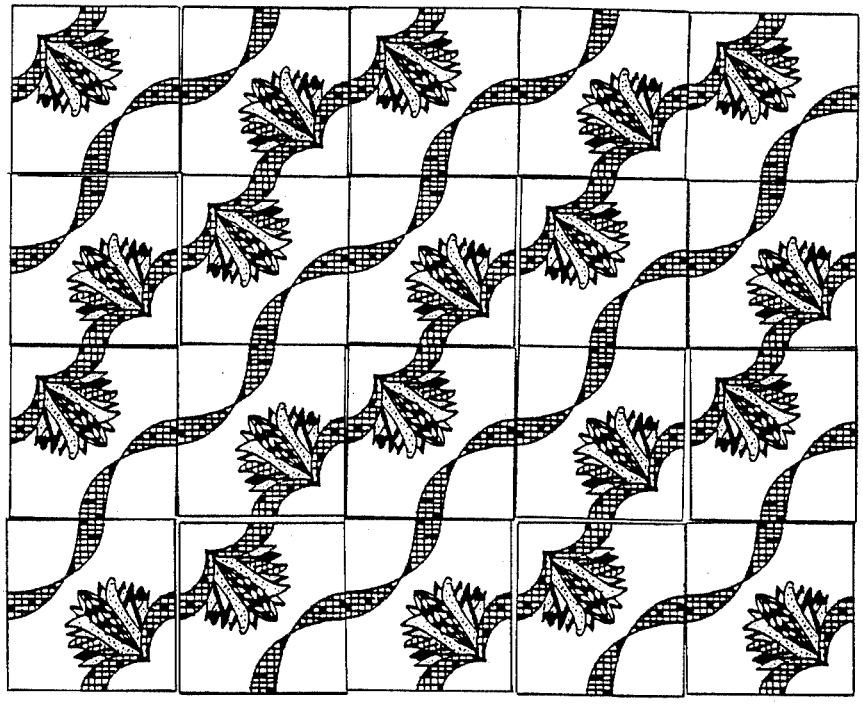

FIG. 8, which is formed of identical units or tiles differently arranged, shows diagonal garlands which alternate between a plain ribbon-like garland and a flower-like garland.

Figure 9:
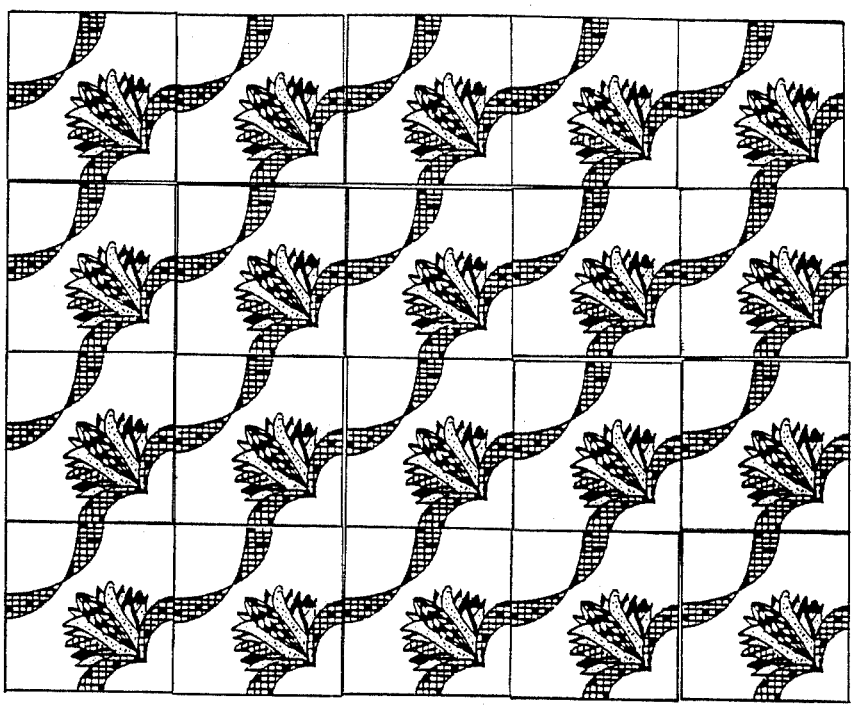

FIG. 9 also uses the same tiles rearranged to provide a diagonal floral or garland pattern with all of the diagonal members being identical.

Figure 10:
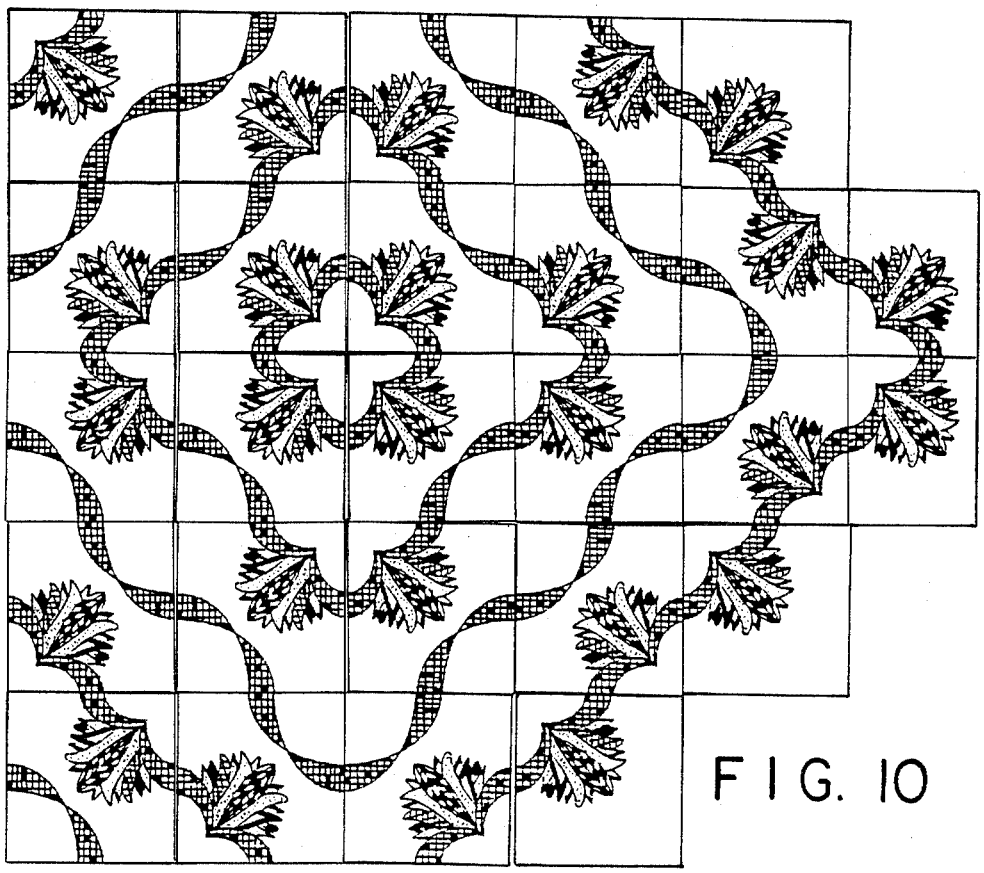

FIG. 10 shows a further differing design formed again from the same units or tiles with a regular pattern comprising a series of closed generally rectangular floral patterns.

Figure 11:
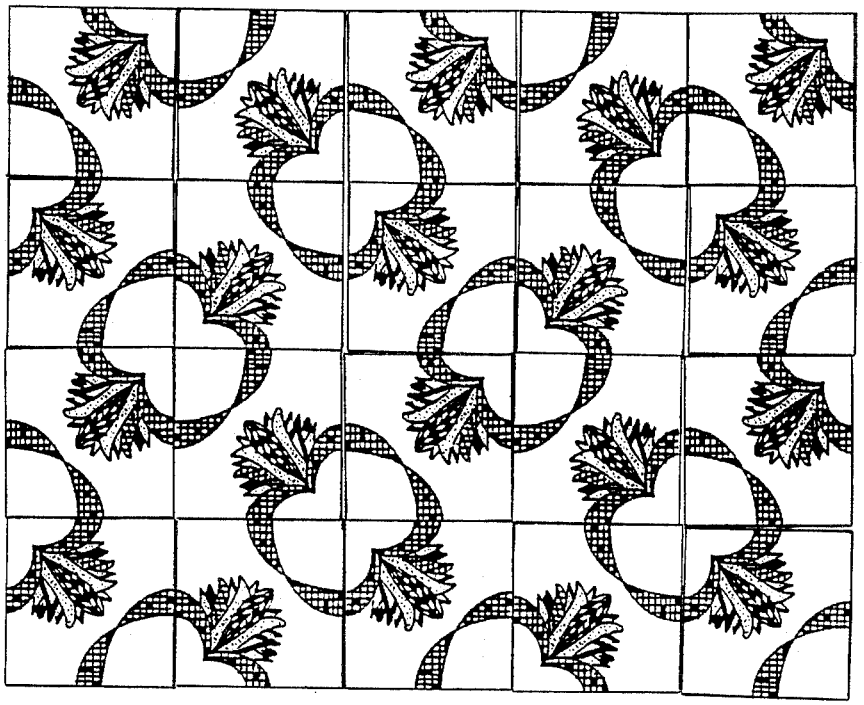

FIG. 11 shows another one of the many design possibilities comprising discreet floral-like designs arranged in diagonal lines.

Figure 12:
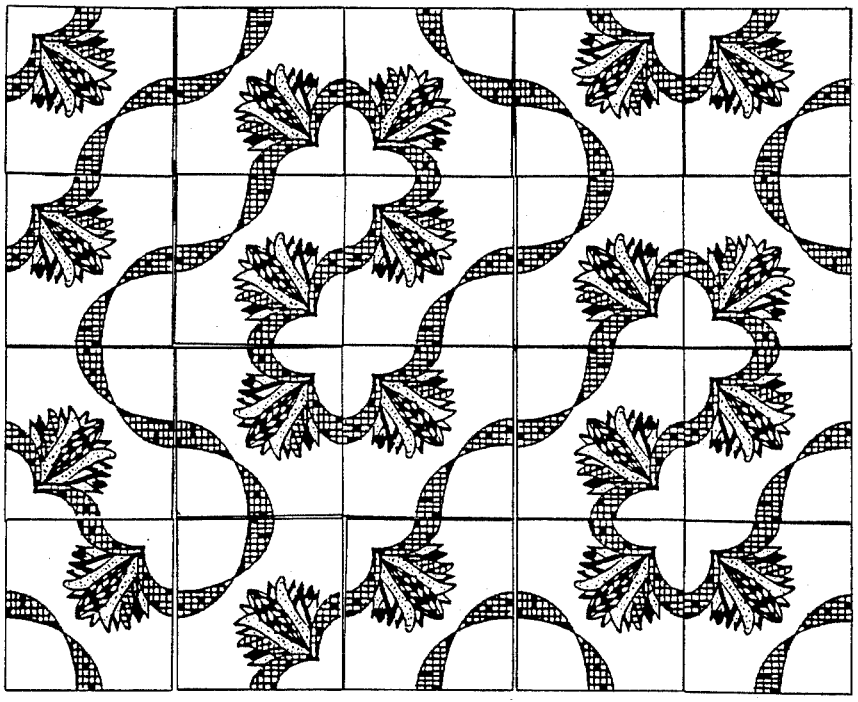

FIG. 12 illustrates a design using the same units or tile which describe and comprise a winding garland pattern.

As described above in the discussion of the total number of designs available, numerous additional designs or patterns may be made. In certain of the design in which larger patterns are employed and where each larger pattern is formed from a number of units or tiles, it may be desirable to have a slightly differing marginal or border treatment. For this purpose, slightly modified tiles may be used.

FIG. 13 illustrates a decorated unit in accordance with the invention of the general pattern already described, for example, in forming designs such as those illustrated in FIGS. 7 through 12. The unit of FIG. 14 includes only the design from the lower left corner of the FIG. 13 unit while the unit of FIG. 15 utilizes only design from the upper left hand corner. FIG. 16 shows these additional units providing marginal or completing portions for designs whose central portion will normally include a number of tiles of the form shown in FIG. 13.

As described above, units in the form of rectangles (as shown in FIGS. 17A, 17B and 17C) may also be used to carry out the decorating method of the invention. FIGS. 17A, 17B and 17C illustrate units N, O and P, respectively, in the form of a rectangle with its sides having a 1 to 2 relationship. These units of FIGS. 17A, 17B and 17C have a number of design forming fragments which reach the shorter sides at their mid-points and which reach the longer sides at two positions equally placed from the unit corners. This arrangement of the fragments of the design permits the units to be reassembled in a variety of relationships producing a large number of differing designs for the reasons already discussed. In FIG. 17 such a design is shown with a number of the units combined. In addition to the main unit N (FIG. 17A), additional units O (FIG. 17B) and P (FIG. 17C) are shown which include only a portion of the design. These units are useful in finishing off the edge portions of a larger pattern. The units O, for example, are shown finishing off the top of the design and the P units are shown completing the left hand margin of this design.

Figure 18:
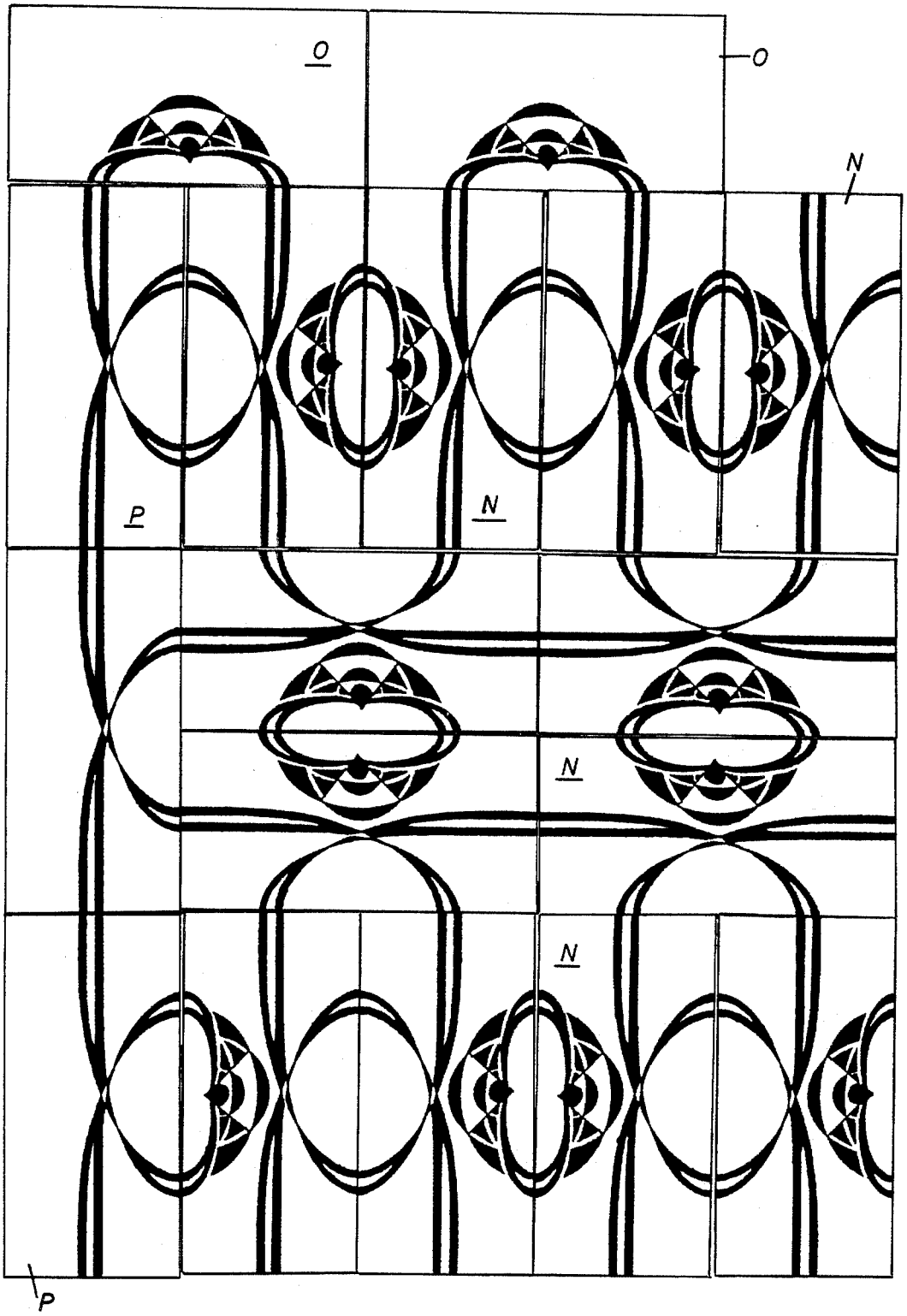

FIG. 18 illustrates the same basic units arranged in a differing pattern with the relative horizontal and vertical positions rearranged in a differing pattern and with the P and O units again forming a margin.

Figure 19:
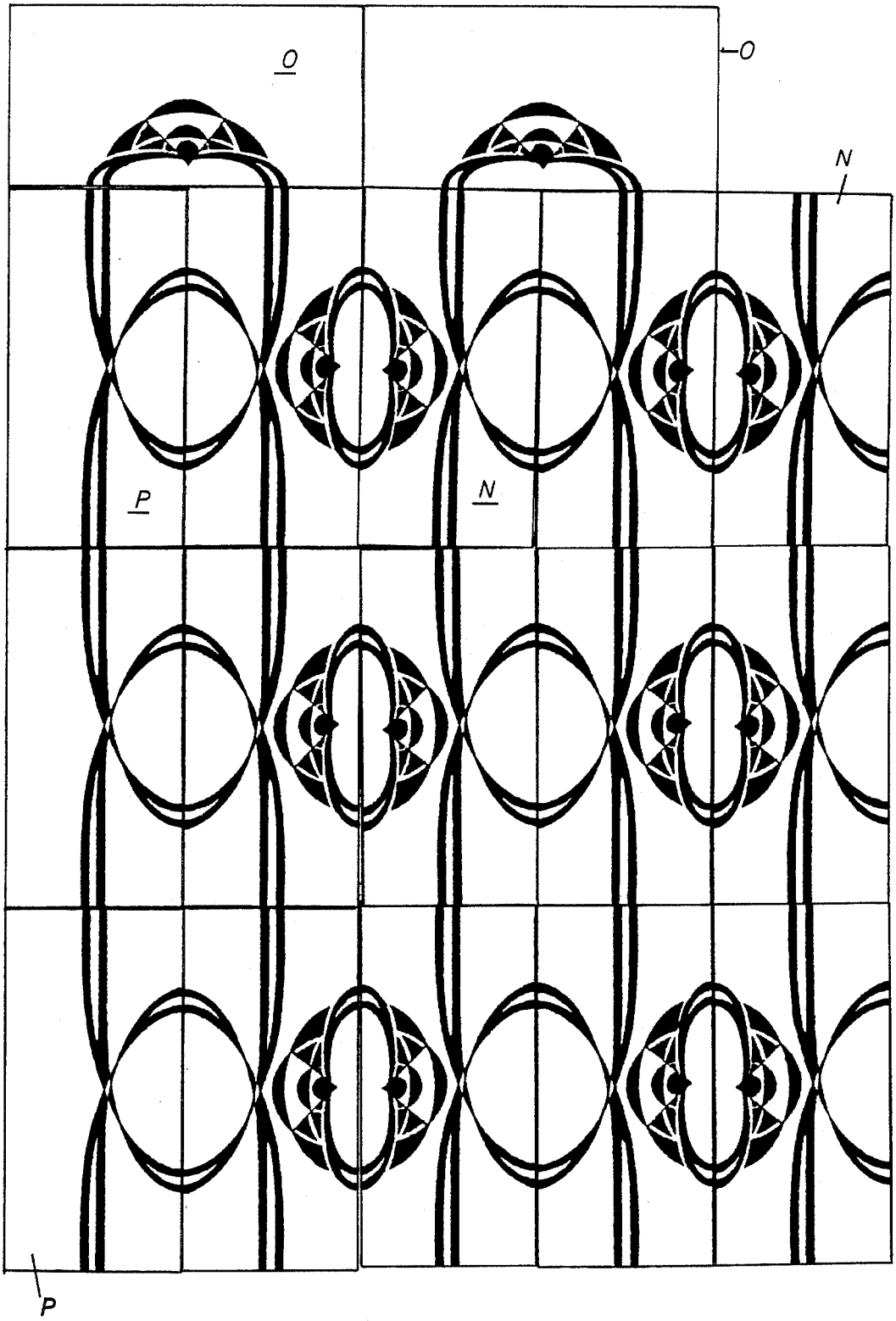

FIG. 19 shows a further and differing design or arrangement using these same rectangular units.

Figure 20:
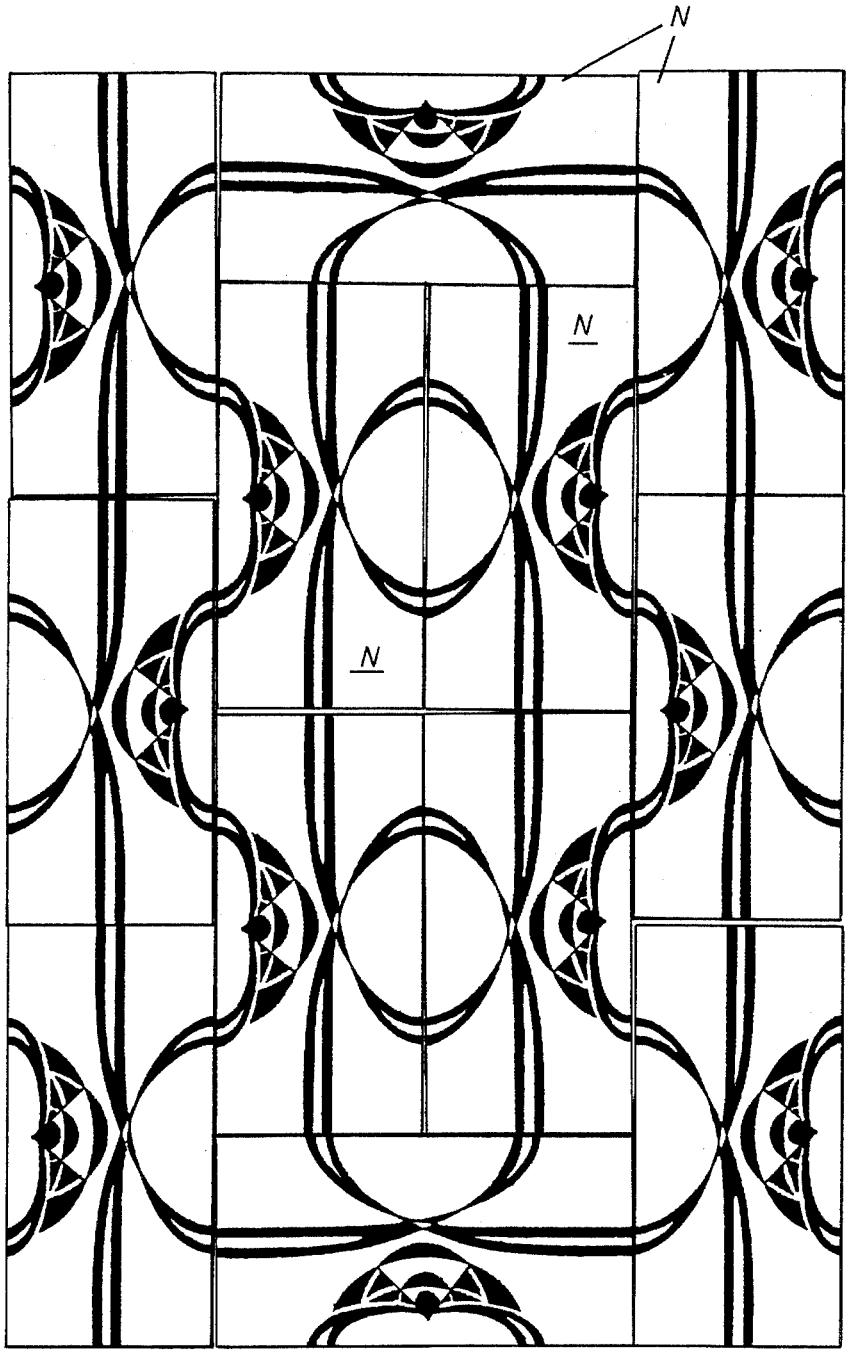

FIGS. 20, 21 and 22 illustrate still further arrangements of the rectangular N units arranged in differing positions giving differing overall patterns.

Areas for use of these units include interior and exterior walls, facades, floor coverings, and a variety of other exposed surfaces or structures. The units may be in the form of bricks, blocks, wall paneling, tiles, and other building materials. Also railings, tracery metal enclosures, balconies, fences, doors, window frames, parapets and other enclosing materials made from metal and manufactured by different methods of cold and hot metal treatment such as casting, chasing, pressing, carving, forging, bending, netting, welding, etc.

Also carpet may be designed in accordance with the invention to permit the formation of various decorative floor designs and to allow a change of the design periodically by interchanging the positions of separate unit carpets.

Also the invention may be used for games of differing degrees of complexity based on the forming of numbers of decorative, artistic compositions from a limited number of units including games with the application of poligrafic means, volumetric and applied games, mechanic games with image illuminations, etc.

As various changes may be made in the form, construction and arrangement of the parts and steps herein without departing from the spirit and scope of the invention and without sacrificing any of its advantages, it is to be understood that all matter herein is to be interpreted as illustrative and not in a limiting sense.

Having thus described my invention, I claim:

1. A decorative unit comprising:

(a) A design positioned on a planar surface of said unit whose border is defined by four lateral edges of equal length or multiples thereof to enclose a rectangular configuration or defined by six lateral edges to enclose a regular hexagonal configuration;

(b) the design being asymmetrically disposed within said configuration with respect to the geometric center thereof;

(c) at least one portion of said design terminating with an edge segment disposed on a lateral edge and all the lateral edges having at least one edge segment;

(d) all the edge segments disposed on the lateral edges the same distance from the nearest point of intersection of two lateral edges being of equal width;

(e) said at least one edge segment being disposed on a lateral edge with the proviso that if an odd number of edge segments are disposed on a lateral edge then one edge segment is disposed on and symmetrically disposed about the midpoint of said lateral edge and if an even number of edge segments are disposed on a lateral edge then each edge segment of a pair are disposed the same distance from the midpoint of the lateral edge;

(f) the area proximal each edge segment disposed the same distance from the nearest point of intersection of two lateral edges having the same color characteristics;

(g) a length of a lateral edge commencing from the point of intersection of two lateral edges and including one edge segment being identical to an equal length on each of the other lateral edges commencing from the point of intersection of two lateral edges with regard to the location, width, number and color characteristic of the edge segment disposed thereon; and (h) said decorative unit being adapted to mate with any side of a lateral edge of an identical decorative unit whereupon the joint edge segments can form a variety of continuous distinctive patterns without disruption of the color characteristics between said joint edge segments.

2. The decorative unit of claim 1 wherein the border is defined by four equal lateral edges and each lateral edge has one edge segment disposed on and symmetrically disposed about the midpoint of the lateral edge.

3. The decorative unit of claim 1 wherein the border is defined by six lateral edges and each lateral edge has one edge segment disposed on and symmetrically disposed about the midpoint of the lateral edge.

4. The decorative unit of claim 1 wherein the border is defined by four lateral edges in which two opposed lateral edges are multiples of the other two opposed lateral edges and each lateral edge of the smaller opposed lateral edges has one edge segment disposed on and symmetrically disposed about the midpoint of the lateral edge and each lateral edge of the larger opposed lateral edges has at least one pair of edge segments in which each edge segment of a pair is disposed the same distance from the midpoint of the lateral edge.

5. The decorative unit of claim 1 made of a material selected from the group consisting of ceramic, glass, concrete, wood, plastic and fabric.

6. The decorative unit of claim 1 combined with a plurality of similar units to form a distinct design pattern.

7. The decorative unit of claim 1 being a ceramic tile and combined with a plurality of similar ceramic tiles to form a distinct design pattern.

8. The decorative unit of claim 1 being a mosaic unit and combined with a plurality of similar units to form a mosaic design pattern.

9. The decorative unit of claim 1 for use in games wherein said unit is combined with a plurality of similar units in various orientations to form distinct patterns.

10. The decorative unit of claim 1 for use in carpeting and wherein said unit is combined with a plurality of similar units to form a distinct design pattern.

11. The decorative unit of claim 10 being a carpet tile.

12. The decorative unit of claim 1 for use in covering walls, floors or exposed surfaces of structures and wherein said unit is combined with a plurality of similar units to form a distinct design pattern.

13. The decorative unit of claim 6 wherein units having less than the full design are included and are disposed at the periphery of the distinct design pattern.

14. The decorative unit of claim 2 combined with a plurality of similar units to form a distinct design pattern.

15. The decorative unit of claim 14 forming a design pattern wherein one or more of the units have less than the full design.

16. The decorative unit of claim 3 combined with a plurality of similar units to form a distinct design pattern.

17. The decorative unit of claim 16 forming a design pattern wherein one or more of the units have less than the full design.

18. The decorative unit of claim 4 combined with a plurality of similar units to form a distinct design pattern.

19. The decorative unit of claim 18 forming a design pattern wherein one or more of the units have less than the full design.

20. The decorative unit of claim 1 combined with a plurality of similar units and a plurality of decorative units having four equal lateral edges to form a distinct design pattern.

21. The decorative unit of claim 1 wherein said unit is adapted to mate with identical described units to provide a three dimensional design.

* * * * *